US006899335B2

(12) United States Patent
Wilson

(10) Patent No.: US 6,899,335 B2
(45) Date of Patent: May 31, 2005

(54) METHOD AND APPARATUS FOR A LEARNING SYSTEM

(75) Inventor: Carla G. Wilson, 3401 Lismore Dr., Conyers, GA (US) 30012

(73) Assignee: Carla G. Wilson, Conyers, GA (US)

( * ) Notice: Subject to any disclaimer, the term of this patent is extended or adjusted under 35 U.S.C. 154(b) by 0 days.

(21) Appl. No.: 10/289,556

(22) Filed: Nov. 7, 2002

(65) Prior Publication Data

US 2004/0090010 A1 May 13, 2004

(51) Int. Cl.[7] ..... F41J 9/00
(52) U.S. Cl. ..... 273/317; 434/245
(58) Field of Search ..... 273/317, 403, 273/408, 348, 348.2, 348.3, 236, 273, 461, 243, 292, 308, 307, 254; 434/245; D21/303, 307, 308

(56) References Cited

U.S. PATENT DOCUMENTS

| | | | | | |
|---|---|---|---|---|---|
| 772,344 | A | * | 10/1904 | Dupeire | 273/317.6 |
| D52,034 | S | | 5/1918 | Brocklebank | |
| D214,568 | S | | 7/1969 | Shannon | |
| 3,979,117 | A | | 9/1976 | Worsham | |
| 4,121,823 | A | * | 10/1978 | McBride | 273/249 |
| D279,302 | S | | 6/1985 | Wood | |
| D296,708 | S | | 7/1988 | Garrett | |
| 4,934,709 | A | * | 6/1990 | Peterson | 273/249 |
| 5,118,113 | A | * | 6/1992 | Ahlers et al. | 273/243 |
| 5,152,535 | A | * | 10/1992 | Roberts | 273/249 |
| 5,449,177 | A | * | 9/1995 | Naylor | 273/236 |
| 5,657,992 | A | * | 8/1997 | Bellizzi | 273/273 |
| 5,743,528 | A | * | 4/1998 | Downey-Jerome | 273/249 |
| 5,850,885 | A | | 12/1998 | Clark et al. | |
| 5,967,518 | A | | 10/1999 | Rowe | |
| 6,059,290 | A | * | 5/2000 | Neil | 273/243 |
| 6,116,605 | A | * | 9/2000 | Davey, III | 273/348.3 |
| 6,196,549 | B1 | * | 3/2001 | Bennett | 273/299 |
| 6,315,292 | B1 | | 11/2001 | Howlett et al. | |
| 6,322,369 | B1 | | 11/2001 | Patterson et al. | |
| 6,517,075 | B1 | * | 2/2003 | Yoon | 273/348.3 |
| 6,702,586 | B1 | * | 3/2004 | Miller | 434/406 |

FOREIGN PATENT DOCUMENTS

GB 2227945 A * 2/1989

OTHER PUBLICATIONS

Shop, Trivial Pursuit, 2000, http://software.cheap–internet–store.com/Childrens_Software, 1 page.*
Winning Moves, Trivial Pursuit Know–it–All Edition, 2000, www.winning–moves.com/products/trivial_pursuit.htlm, 1 page.*
Gameroom, Trivial Pursuit Rules of Play, 2000, www.game-room.com/gambits/rules/076_Trivial_Pursuit_Rules.htlm, 6 pages.*
Wiley, Non–Sequitor Comic, Jun. 29, 1993, Washington Post Newspaper.*

* cited by examiner

*Primary Examiner*—Gregory Vidovich
*Assistant Examiner*—M. Chambers

(57) ABSTRACT

Disclosed herein is a learning system that uses the concept of tossing a token (dart) at a specifically designed game board for individual or team players. Included in this invention are variations of the learning system involving religious, phonetic and phonological awareness, vocabulary, geography, mathematical, historical, and other facts. This system incorporates the concepts of the general game playing skills and tactics of a commonly known game, darts, but further incorporates the concept of using various facts and a point earning scheme to constitute a learning system that while educational is also entertaining. This learning system includes but is not limited to darts and dart boards because the game board can be made from various materials that will allow it to be safely used by children and adults of all ages both indoors and outdoors.

3 Claims, 5 Drawing Sheets

METHOD AND APPARATUS FOR A LEARNING SYSTEM

FIELD OF INVENTION

The present invention relates to games generally, and more specifically, games which utilize throwing pieces and playing surfaces onto which the throwing pieces are thrown. More specific still, the invention relates to a learning system using the concept of tossing a token at a specifically designed game board for use by one or more people.

The present invention provides both a unique playing strategy and provides an educational stimulus. Included in this learning system are variations of the learning system involving religious, phonetic and phonological awareness, geography, vocabulary, alphabets, mathematical, historical, and other facts. This system is a combination of the general game playing skills and tactics of a commonly known game, darts, incorporating various facts and a point earning scheme to constitute a learning system that while educational is also entertaining.

BACKGROUND OF THE INVENTION

The game of darts is well known and is played internationally. Throughout history there have been numerous variations and various methods of play.

The traditional darts game involves a single or a team of players. A game by which the players try to score points by throwing darts at a target. The target is divided into wedge-shaped areas. The wedges are worth from 1 to 20 points. A player scores 1 to 20 points by hitting different wedges. A regulation dartboard measures 18 inches and is divided into 20 equal sections shaped like wedges of a pie. The object of this tradition game is that a player must score a certain number of points—in most cases 301, 1001, 3001.

The prior art contains a number of different types of games that are played using a traditional circular dartboard. In some cases, the surface of the board has been reconfigured for a specific type of game and in others the game has required that the board have a significantly different surface design and shape. The following examples are cited.

U.S. Pat. No. 3,979,117 is entitled "Football Dart Board Game." The game-board in this patent consist of three traditional circular boards that have been modified and are to be hung adjacent to one another. Each of the three different boards has target areas that represent specific results for different types of American football plays. The three boards represent offensive plays such as various running, passing and kicking plays, respectively. One of the objects of the invention is that the scores between the two opposing players be indicative of their respective dart throwing and play selection abilities.

U.S. Design Pat. No. 296,708 is entitled "Dartboard or the Like." This Design Pat., No. '708 discloses in FIGS. 1 and 2, what appears to be a traditional circular dartboard. However, the target area of the board has been reconfigured to have the appearance of a standard billiards table with six pockets and fifteen billiard balls "racked" into the typical triangle configuration. In addition, FIG. 3 of Design Pat. No. '708 shows essentially the same illustration as FIG. 1 applied to a rectangular board. There is no disclosure as to how a game would be played on the illustrated boards.

U.S. Pat. No. 5,050,890 is entitled "Dart Board Game." The '890 patent discloses a dart game in which the dartboard is subdivided into two separate zones. A number of circular targets are arranged in each zone. A player throws at the targets in the other player's zone. Spaces are marked in each zone of the dartboard for introducing different strategies into the game. Such spaces are usable to increase or decrease the number of darts in the game, or to increase the number of hits required to destruct a circular target. The object of the game is for each player to destroy the other player's targets by throwing darts onto such targets a specified number of times. The winner is the player who first destroys all of the other player's targets. The game disclosed in the '890 patent is limited to two players.

U.S. Design Pat. No. 350,158 is entitled "Lotto Dart Board." The dartboard illustrated in Design Pat. No. '158 appears to be a standard circular dartboard, the target area of which has been divided into variously sized and shaped spaces that are randomly numbered from one to forty. The board is illustrated as having an inner and an outer bull target areas. Although no disclosure concerning the board's use is provided, one might speculate that the board is intended to be used by persons who participate in lottery drawings where numbers are randomly drawn to determine a winning combination of numbers.

U.S. Pat. No. 5,417,437 is entitled "Dart Board and Method of Manufacture." This patent discloses a traditional circular dartboard comprising a bristle board, inner and outer bull target areas, and radial target areas arranged around the bulls. The novelty of this invention appears to be derived from the interlocking nature of strips that are mounted on the board and which delineate between the different target areas on the board's surface. Formerly, target areas were delineated with heavy gauge wire or non-interlocking strips that were prone to being bent resulting in an alteration of the shapes of the various target areas.

U.S. Design Pat. No. 365,601 is entitled "Dart Board." The disclosure of this patent is illustrated as a traditional circular dartboard that typically utilize darts with plastic tips. It is also well known in the art that such boards will be equipped with electronic automated scoring.

U.S. Pat. No. 5,540,446 is entitled "Covers and Target Pattern Appliqués." This patent is directed to covers and removable replaceable target patterns appliques for use with standard circular dartboards, archery targets, and the like. The covers allow the user to remove and replace a variety of target patterns. The invention comprises a frame that is attached to a standard circular dartboard, means for holding the frame on the board, and a target pattern to be placed in the frame. Although the disclosure of the '446 patent indicates that target patterns other than traditional dart board designs can be placed on the targets, the disclosure does not include or describe a specific target pattern or any new games that might be played on that target pattern.

U.S. Design Pat. No. 373,147 is entitled "Game Target." The drawings appear to disclose a specially configured dartboard having the design of a baseball field. Special target areas are designated for home plate, the pitcher's mound, the three bases and left and right fields. The game board further incorporates a scoreboard with designations for one player or team to represent the home team and the opponent(s) to be the visitors. No method of playing a game on the board is disclosed.

U.S. Design Pat. No. 382,600 is entitled "Dart board." The illustrated board appears to be a traditional circular dartboard that has automated electronic scoring on displays below the board. The illustrations of the board suggest that plastic tipped darts are used as is well known in the art for these types of dart game-boards.

U.S. Pat. No. 5,850,885 is entitled "Method and Apparatus for a Game." The game involves throwing darts onto specially designed dartboard. The board is subdivided into different targets each having a number of point areas. Each target is associated with a specific player although only the player knows the identity of his or her target. During the game, players take turns throwing darts at the targets. When a dart lands on a target's point area, the points are scored against that target. When a target's score reaches or exceeds a set elimination value, the player associated with that target is eliminated from the game. Further, during the game, a player may identify his or her target after their score exceeds a set 'FESSUP™' value. After identifying one's own target, the player can deduct points from his or her score by landing darts in his or her own target point areas.

None of the aforementioned prior arts, either singularly or combined teach or render obvious the invention described and claimed herein. While each of the aforementioned existing games may be effective for their intended purposes, each of the prior board games are deficient in the educational elements that make a game beneficial to both children and adults. Failure to adequately challenge individuals to learn and increase their knowledge is a common problem with such conventional dart games. The present invention overcomes the shortcomings of the prior art by setting forth a learning system for educating participants on a specific subject and thus adds a new dimension to the existing games. More specifically, the present invention has a game board displaying various specifically designed shapes that depict the subject that the facts/questions are to be answered to teach different lessons and to score points.

In addition, the present unique strategy and game board of this learning system provides an educational stimulus. This present invention enables players to gain confidence in their skills in various subjects and will provide a solid foundation upon which they continue to build their knowledge and confidence in that subject area. The present invention also provides a strategy and a scoring system that allows participation by players of all ages at the same time.

SUMMARY OF THE INVENTION

The present invention provides a new game that combines the elements of learning and throwing skills such that a number of different players may compete effectively with one another regardless of their respective throwing abilities.

Further, the present invention provides an educational dart game and learning system that will overcome the shortcomings of prior art devices.

Furthermore, the present invention provides an educational dartboard and learning system including specifically designed surfaces depicting the subject matter to be learned.

Still further, the present invention provides an educational dart game and learning system that includes an apparatus and concepts that teaches scripture, words, alphabets, spelling, events, historical facts, music, . . . etc., with specifically designed dart boards.

In addition, the present invention provides an educational learning system able to accommodate playing a plurality games while providing an effective learning tool for children and adults.

Additionally, the present invention provides an educational learning system that encourages players to learn how to use and appreciate the value of reference materials such as a concordance, Bible, dictionary, encyclopedia, . . . etc.

The present invention also provides an educational learning system that is simple and easy to use. The learning system is simple enough to generate interest in children at an early age, yet challenging enough at its higher levels of play so as to maintain interest in older children and adults.

The present invention relates to a learning system for educating participants on a specific subject and thus adds a new dimension to this old game. More specifically, the present invention has a game board displaying various specifically designed shapes that depict the subject that the facts/questions are to be answered to teach different lessons while scoring points. The areas of the board surface are marked with an alphabet, religious, phonetic, geographical, history or other fact or personality. Furthermore, the present invention is not limited to the current twenty target area darts game board and thereby enhancing the traditional games. The present invention board is divided into as many sections as required to depict the subject matter. For example, a board to teach the English alphabet or words would be divided into a minimum of twenty-six distinct areas having a letter (upper and/or lowercase) of the alphabet occupy each of these areas. A second example, US history would have a board that had a minimum of fifty distinct areas shaped like each of the states of the United States.

Furthermore, the present invention provides an intriguing and challenging system that has educational value as well as providing entertainment. In regards to the educational value, it builds, enhances, and develops knowledge about many facts and subjects such as words, alphabets, phonetics, phonological skills, scripture, places, historical facts, people, numbers, and math functions and many others. Although this system is easily adapted to electronic media, such as a computer, hand held game, television screen, or the like, this invention can be implemented in a simple and easily-manufactured manner that is easy to understand and it can be easily manufactured and sold relatively inexpensively. In addition, this learning system allows more energy and skill to be expended than is required/allowed by electronic media.

Additionally, the present invention provides a learning system that combines the elements of chance and throwing skills such that a number of different players can participate and effectively compete with one another regardless of their age or throwing abilities while learning or improving knowledge in a specified area. In addition, the scoring system is such that a player can compete to enhance or improve their highest individual score or with timed device such as a clock. Ultimately, the present unique strategy and game board of this learning system provides an educational stimulus. The present invention also provides a scoring system that allows participation by players of all ages at the same time.

The features and advantages of this invention will become more apparent upon reading the following specification, when taken in conjunction with the accompanying drawings. It is intended that all such additional features and advantages be included therein with the scope of the present invention, as defined by the claims, wherein is set forth by way of illustration and example, embodiments of this invention.

BRIEF DESCRIPTION OF THE DRAWINGS

The invention can better be understood with reference to the following drawings. The components in the drawings are not necessarily to scale, emphasis instead being placed upon clearly illustrating the principles of the present invention. In the drawings, like reference numerals designate corresponding parts throughout the several views. It is to be noted however, that the drawings illustrate only a few of the embodiments of the invention and are not to be considered limiting of its scope as the invention may admit to other equally effective embodiments.

DETAILED DESCRIPTION OF A PREFERRED EMBODIMENT

Figure 1A:
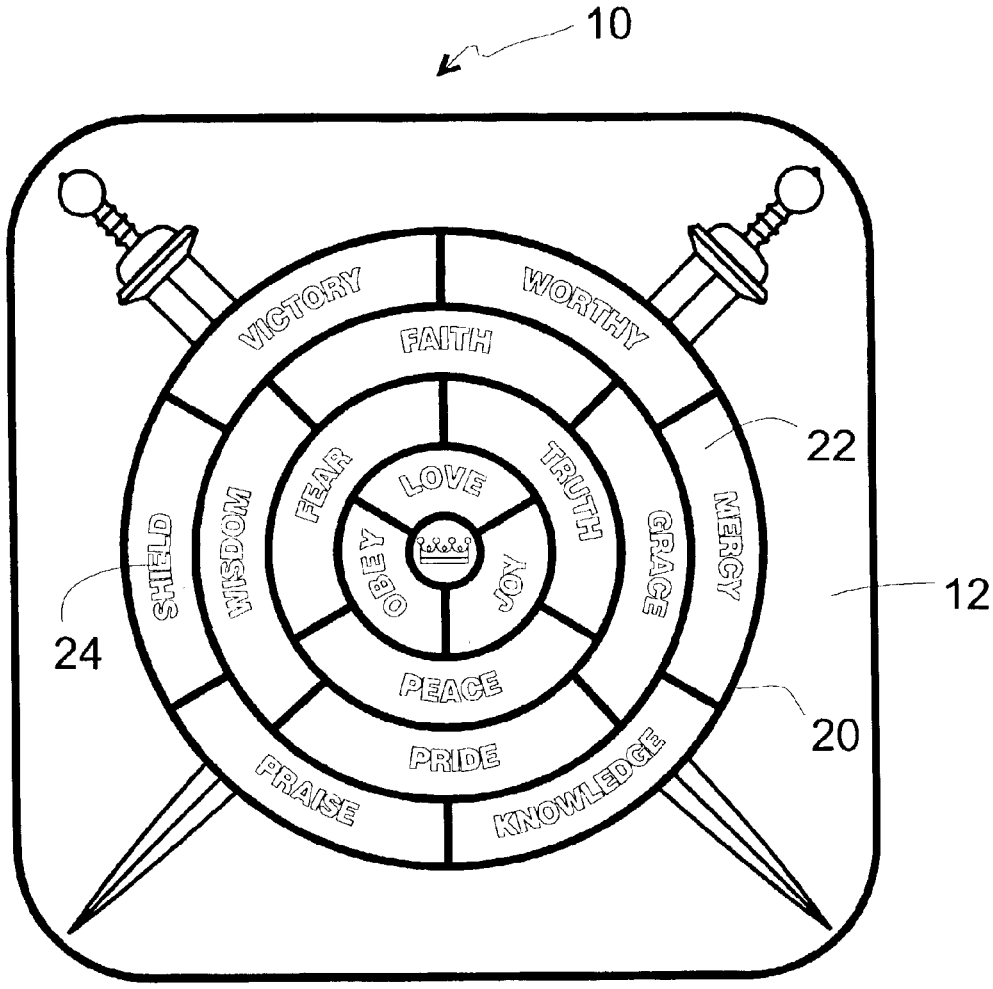
FIG. 1A is a frontal view of an apparatus of the present invention depicting the playing surface as being subdivided into a plurality of target areas, the target areas being on a specific subject. This subject area is religion.

In it's most general state, the present invention relates to a learning system and apparatus for assisting at least one player in learning a plurality of subjects. This learning system consists of at least one game piece and a playing surface containing a plurality of subject-matter identifying target areas on the playing surface. A player uses the game piece to identify one of the target areas and then attempts to perform an intellectual activity corresponding to the subject matter identified by the target area identified with the game piece. Information in the target areas can be changed from game to game.

Intellectual activity as used herein includes facts, words, and clues. Facts are understood to be those things that have actually happened, known to exist, reality, or truth. Words are understood to be a unit of language, consisting of one or more spoken sounds or their written representation, representing an individual concept, action, or feeling, or having a single referent, usually separated by spaces in writing; an expression or utterance. A clue is understood to be anything that serves to guide or direct in the solution of a problem or mystery, etc. A player can choose to perform the intellectual activity with or without reference materials.

The present invention provides both a unique playing strategy and provides an educational stimulus for many subject areas including religion, U.S. History, facts about the individual states within the U.S., musical facts, mathematical principles, business, financial, chemical, biological, and other scientific facts, world history as well as facts about other nations.

Points are awarded based on the target area identified by the game piece and a correct response by the player. If the player does not respond correctly a penalty results and can be in the form of no points or points added or subtracted to the players score. A player can choose to use reference materials to perform the intellectual activity and the points are awarded based on the choice. In addition, a player can choose to perform the intellectual activity prior to or after the game piece is used and the points are awarded based on their choice.

Whereas the present invention is capable of embodiment in various forms, shown in the drawings some of the embodiments with the understanding that the present disclosure is to be considered as an exemplification of the invention, and is not intended to limit the invention to the specific embodiment illustrated.

Though the invention is described herein as being embodied using a dartboard playing surface and utilizing darts (safety or traditional) as the game pieces, it is anticipated that the invention may take the form of a variety of different types of playing surfaces and game pieces such as a roulette wheel, shuffle board, wheel of chance and others. Further, the playing surface should not be understood as being limited to use in a vertical application as the game board might be designed for use on either a vertical or horizontal playing surface as well as indoors and/or outdoors.

The game pieces and the playing surface will be complementary in the sense that the playing surface will receive tossed game pieces and or the tossed game pieces will attach to the playing surface. The types of materials used to play the game will depend largely on the age of the players. Young children can safely play the game using game pieces and a playing surface covered with hook and loop material, e.g. VELCRO®, while older children and adults can play the game using traditional darts and dart boards (specifically designed for the learning system). If the learning system is to be played on a horizontal surface such as a floor, game pieces such as beanbags may be tossed. Since it is anticipated that the game will be adapted for play both indoors and out, additional types of game pieces can be used.

Figure 3:
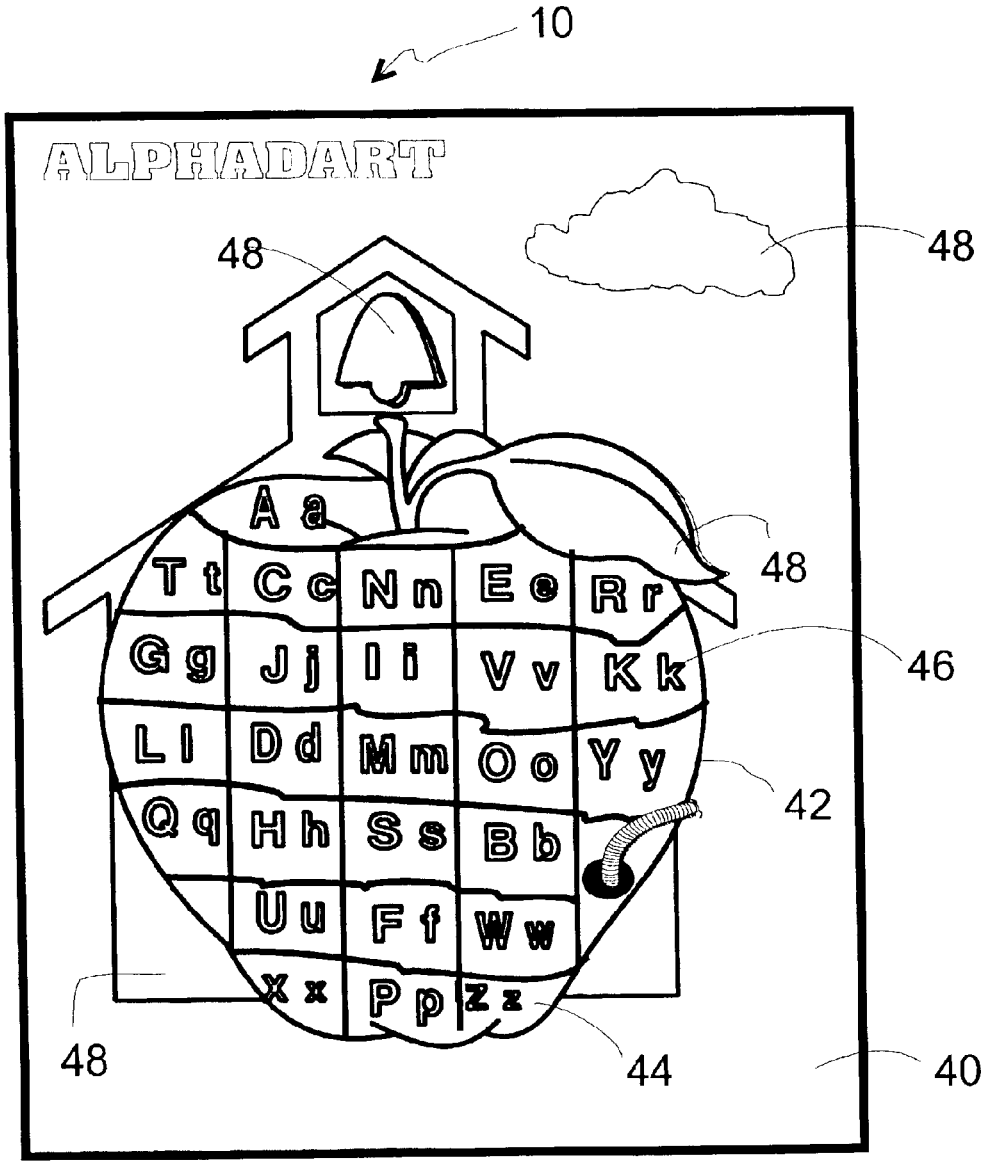
FIG. 3 is a frontal view of an apparatus of the present invention depicting a second playing surface as being subdivided into a plurality of target areas, the target areas being on a specific subject. This subject area is alphabets.

Referring now in more detail to the drawings, in which like numerals indicate like parts throughout the various views, FIGS. 1A, 3 illustrates the learning system apparatus 10 of this present invention. The present invention includes the learning system playing surface 12, 40 having a target 20, 42 respectively. The target is divided into many target areas (point spaces) depending on the subject area to be studied.

Figure 2A:
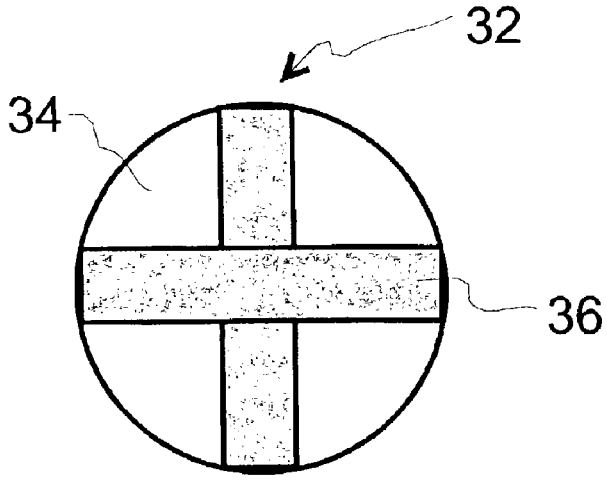
FIG. 2 is a two dimensional view of an apparatus of the present invention depicting the preferred game piece, safety dart (ball with Velcro strips).
Figure 2B:
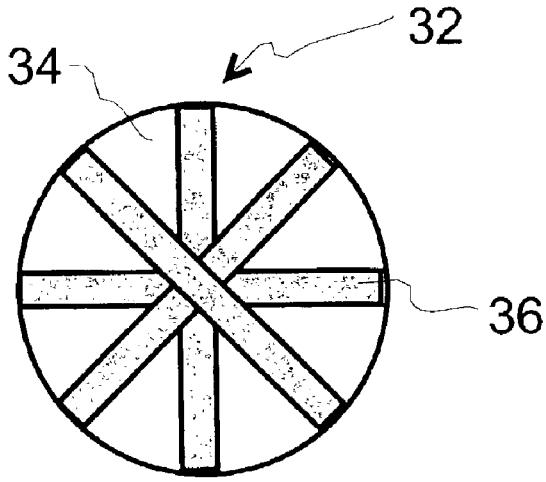

This present invention, a learning system apparatus will include a number of game pieces. The appropriate type of game piece used for the learning system can be varied based on factors such as the age of the players, the orientation of the game board surface, whether the game is to be played indoors or out, and most importantly, the game board surface materials. For vertical applications it is essential that the game pieces be chosen such that they attach to the playing surface. This attachment is most commonly a frictional engagement although the interlocking of hook and loop fastening materials is also anticipated. In the one of the embodiments of the present invention, the game pieces will be plastic balls 34 with hook and loop material strips 36 attached to them as illustrated in FIGS. 2[A]–[B].

Figure 1B:
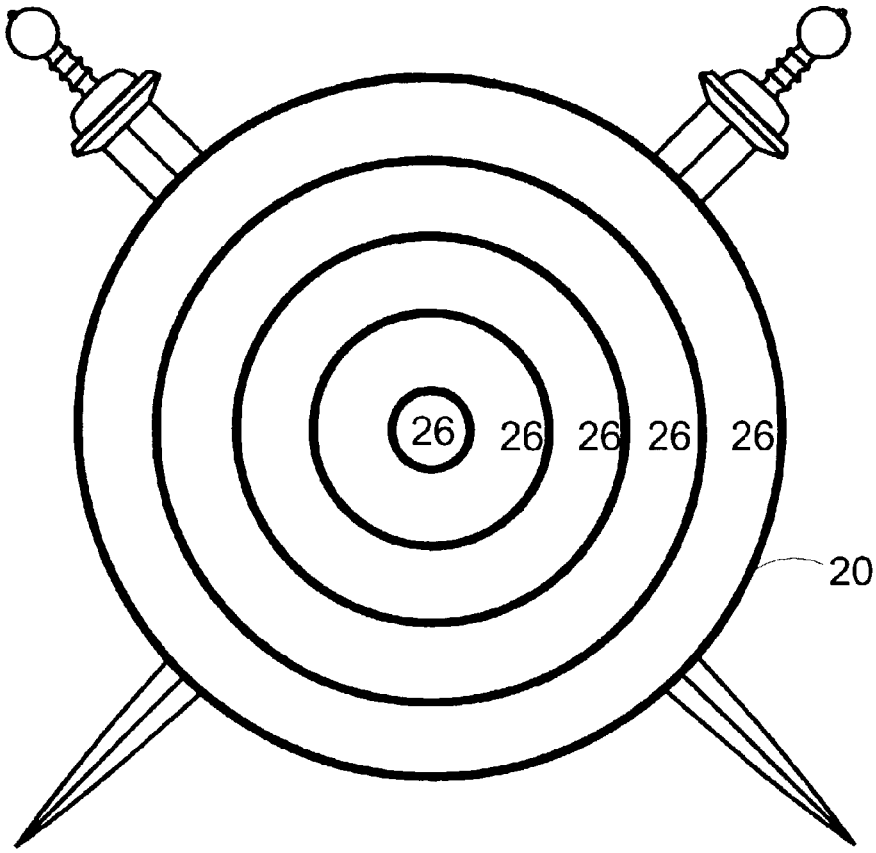
FIG. 1B is a frontal view of an apparatus of the present invention depicting the concentric circles that are subdivided into a plurality of target areas.
Figure 1C:
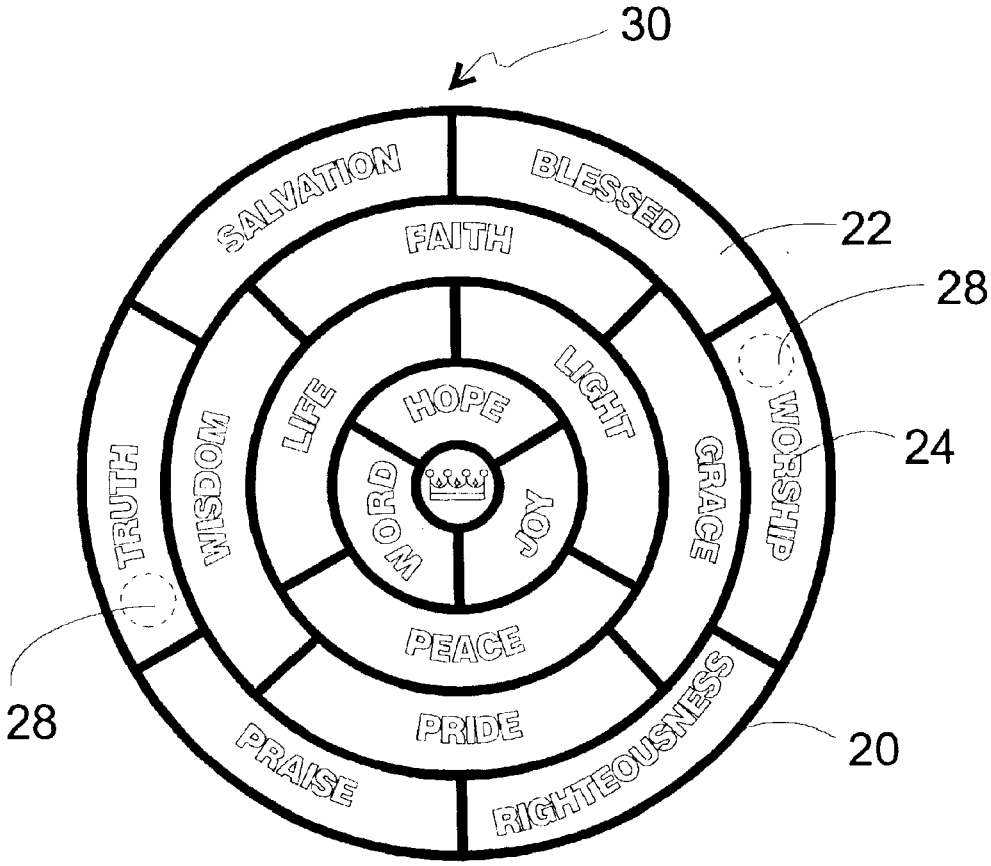
FIG. 1C is a frontal view of an apparatus of the present invention depicting an overlay of a plurality of target areas that allow the original target to be modified with new subject material.

Variations of the target area exist in each of the embodiments of the present invention as evidenced by the description of the figures below:

FIGS. 1[A]–[C] illustrates the Religious version "The Dart Quencher" one of the embodiments of the present invention of the learning system. In FIG. 1A the present invention includes a game playing apparatus 10, having a surface 12 with a target 20. The target 20 consists of five concentric circles 26 that have been divided into seventeen distinct target areas 22. The system is not limited to seventeen target areas 22. Each concentric circle 26 determines the number of points that are awarded for a correct answer. It is expected, but not to be considered limiting, that the innermost circle will have the largest point value with progressively decreasing point values for the target areas (point spaces) farther away from the center.

Each target area should have a means for identifying it separate and apart from the other target areas on the playing surface. Identification means can be accomplished simply by the use of different colors, numbers, words, names, or symbols. Each target area 22 has an inscription 24 contained in it that can be found in but not limited to the Bible.

The method for using the present invention is easily understood. In one of the embodiments of the present invention, the playing surface 12 is oriented vertically on a wall. The playing apparatus 10 is positioned with its top approximately six feet from the floor. FIG. 2[A]–[B] illustrates one of the embodiments game piece 32 that the players toss at the playing surface. The players are approximately seven feet—six inches from the playing surface.

The players determine the order of play by tossing a game piece 32 on the surface, however, any known method may be used that will randomly establish the order of play. The players, in the order of play determined, will each throw a game piece at the target areas of the playing surface. Each target will have means of identifying it from other target areas.

The Sword Drill or Advanced Drill play method (described below) can be used with the whole Bible, New Testament only, or the Old Testament only. Combinations of these provide a total of six (6) different educational game variations. Any combination other than whole Bible and sword drill must be agreed upon at the start of the game. This learning system is not intended to be limited to the methods of use detailed herein.

SWORD DRILL: The player tosses the game piece and is given an allotted time, a suggested sixty seconds to find a scripture containing the inscription 24 in the target area hit by the game piece and read it stating the book, chapter and verse. Any scripture desired can be quoted if the game piece lands in the crown (center) circle.

A score is maintained throughout the game. The game is started with each player having a predetermined or agreed on number of points. This predetermined number of points is suggested to be 300 points for the learning system invention but is not limited to this number of points. The number of points may be set at any desired level, depending on the general skill level of the players and a desired length of the game.

A player's objective, other than learning scripture, in order to win the game is to be the first to reach zero points. However, everyone is considered a winner by hearing and learning the scripture. The Sword Drill serves as a building block in learning and memorizing scripture. An additional educational feature is that it encourages players to learn how to use and appreciate the value of reference materials. After a period of using the learning system for the Sword Drill it is anticipated that players can apply an alternative method of using the learning system. The alternative method described herein is called the Advanced Drill.

ADVAMCED DRILL: The players recite the scripture verse from memory prior to tossing the game piece. If the game piece lands on a word 24 that is contained in the scripture verse recited, points are doubled and subtracted from the total. If the game piece strikes a word that is not contained in the recited scripture the single value of that target area is subtracted from the total. If no scripture is recited prior to tossing the game piece then the points are added to the total. Any scripture desired can be quoted if the game piece lands in the crown (center) circle. The player is given an allotted time, a suggested sixty seconds to recite a scripture prior to tossing the game piece.

To prevent players from making up or misquoting scriptures a challenge can be made by any player to check the accuracy of the scripture. It is suggested that a scripture not be repeated more than twice per game.

This present invention includes an overlay 30 is designed to attach to the original surface 12 and allows the target areas 22 to be modified with new subject areas 24.

FIG. 3 illustrates the Alphabet version "ALPHADART" yet another embodiment of the present invention of the learning system. In FIG. 3 this embodiment of the present invention includes a game playing apparatus 10, having a surface 40 with a target 42. The target 42 consists of playing surface that has been divided into twenty-six distinct target areas 44.

Each target area should have a means for identifying it separate and apart from the other target areas on the playing surface. Identification means can be accomplished simply by the use of different colors, numbers, words, names, or symbols. Each target area 44 has an alphabet inscription 46, upper and lower case, contained in it.

The method for using the present invention is easily understood. In this variation of yet another embodiment, the playing surface 40 is oriented vertically on a wall. The playing apparatus 10 is positioned with its top approximately six feet from the floor. This height can be adjusted based on the age of the player. For younger players the suggested height is approximately four feet. FIG. 2[A]–[B] illustrates the embodiments game piece 32 that the players toss at the playing surface. The players are to be approximately seven feet—six inches from the playing surface. This distance can be adjusted for young children.

The players determine the order of play by tossing a game piece 32 on the surface, however, any known method may be used that will randomly establish the order of play. The players, in the order of play determined, will each throw a game piece at the target areas of the playing surface. Each target will have means of identifying it from other target areas. Target areas 48 can be included and are used as free throw areas or to teach other things such as colors, shapes, and objects.

The object of the game is for a player to score points while learning to identify the alphabet, identify words that begin with that alphabet, spelling that word, giving the definition of that word, using that word in a sentence, identifying the word's use in the sentence, i.e., noun, pronoun, verb . . . etc. The desired number of points to end the game is established at the start of each game. The game is over when each person reaches the point goal established at the start of the game.

After each players turn, the points associated with the players throw and correct responses are recorded and or running total is calculated. The point scoring system is preferably as indicated below but may be set at any other desired level, depending on the general skill level of the players and a desired length of the game. The preferable point scoring system is as follows:

| | |
|---|---|
| Alphabet Identification | 10 points |
| Identify Vowels and Consonants | 10 points |
| Word Starting With Alphabet | 10 points |
| Spelling Word | 05 points per letter (5 letters or less) |
| | 10 points per letter (6 letters or more) |
| Definition of Word | 20 points |
| Using Word In a Sentence | 20 points |
| Identification of Part of Sentence | 30 points |

GAME VARIATIONS:

Rules for the Drills (described below) can be used. In addition, a dictionary for the appropriate age group is recommended for all variations and is required for the Dictionary Drill. Choose the Drill based on the age and skills desired to practice and improve. A word should not be repeated more than twice per game. A dictionary (not included) can be used as a reference.

ALPHABET DRILL: The player tosses the dart and is required to identify the alphabet that the dart has landed on. Points are awarded based on the scoring system above.

VOWEL AND CONSONANT DRILL: A player tosses the dart and is required to identify the alphabet that the dart has landed on. The player is then required that letter as a vowel or consonant. Points are awarded based on the scoring system above.

WORD DRILL: The player tosses the dart and is required to identify the alphabet that the dart has landed on. The player is then required to give a word that begins with the letter that the dart landed on. Points are awarded based on the scoring system above.

SPELLING DRILL: The player tosses the dart and is required to identify the alphabet that the dart has landed on. The player is then required to give a word that begins with that letter and to spell the word correctly. Spelling points are awarded, based on the scoring system above, until the player fails to answer correctly.

DEFINITION DRILL: The player tosses the dart and is required to identify the alphabet that the dart has landed on. The player is then required to give a word that begins with that letter. The player is required to spell the word that was given and define that word correctly. Points are awarded, based on the scoring system above, until the player fails to answer correctly.

SENTENCE DRILL: The player tosses the dart and is required to identify the alphabet that the dart has landed on. The player is then required to give a word that begins with that letter. The player is required to provide the correct spelling and define the word. The Player is then required to use the word in a sentence. Points are awarded, based on the scoring system above, until the player fails to answer correctly.

GRAMMAR DRILL: A player tosses the dart and is required to identify the alphabet that the dart has landed on. The player is then required that letter as a vowel or consonant. The player is then required to give a word that begins with that letter. The player is required to provide the correct spelling and define the word. Players are then required to use the word in a sentence. Finally, the player is required to identify the word as a noun, pronoun, verb, adverb, . . . etc., in the sentence. Points are awarded, based on the scoring system above, until the player fails to answer correctly.

DICTIONARY DRILL: This Drill allows players to access the dictionary to provide their responses once the player tosses the dart and identifies the alphabet that the dart has landed on. Players have sixty seconds to find a word that begins with that letter. The players are then required to give a word that begins with the letter that the dart landed on. The player is required to define the word that was given and then spelled correctly. Players are then required to use the word in a sentence. Finally, each player is required to identify the word as a noun, pronoun, verb, adverb, . . . etc., in the sentence. Because the dictionary was used only half of the points are awarded based on the scoring system above up to the point where the player fails to answer correctly.

To prevent players from making up words, spelling, and definitions, a challenge can be made by any player to check the accuracy of words, spelling, and definitions. It is suggested that a word not be repeated more than twice per game to encourage learning new words, spelling, definitions . . . etc.

An alternative method of play for ALPHADART is as follows: The object of the game is for a player to score points while learning to identify the alphabet and identifying characters, books or events that begin with that alphabet that can be found in the Bible. The desired number of points to end the game is established at the start of each game.

After each players turn, the points associated with the players throw and correct responses are recorded and or running total is calculated. The point scoring system is preferably as indicated below but may be set at any other desired level, depending on the general skill level of the players and a desired length of the game. The preferable point scoring system is as follows:

| | |
|---|---|
| Alphabet Identification | 10 points |
| Word Starting With Alphabet | 10 points |
| Find Word In The Bible | 35 points |
| Character Starting With Alphabet | 25 points |
| Event Starting With Alphabet | 30 points |
| Bible Book Starting With Alphabet | 20 points |

GAME VARIATIONS:

Rules for the Drills (described below) can be used. In addition, a Bible for the appropriate age group is recommended for all variations and is required for the Bible Drill. Choose the Drill based on the age and spiritual area desired to increase knowledge. A word, character, book or event should not be repeated more than twice per game. Reference material's that can be used are a Bible, Bible dictionary and concordance (not included). NOTE: Drills can be combined in any combination desired. For example, character and the Bible book drills or word, character, and event drills can be combined.

ALPHABET DRILL: The player tosses the dart and is required to identify the alphabet that the dart has landed on. Points are awarded based on the scoring system above.

WORD DRILL: The player tosses the dart and is required to identify the alphabet that the dart has landed on. The players are then required to give a word found in scripture that begins with the letter that the dart landed on. Points are awarded based on the scoring system above.

FIND WORD DRILL: A player tosses the dart and is required to identify the alphabet that the dart has landed on. The player is then required to give a word found in the scripture that begins with that letter. The players are then required to find that word in a scripture and read the scripture aloud. Points are awarded, based on the scoring system above, until the player fails to answer correctly.

CHARACTER DRILL: The player tosses the dart and is required to identify the alphabet that the dart has landed on. The player is then required to give a character found in the Bible that begins with that letter. Points are awarded, based on the scoring system above, until the player fails to answer correctly.

EVENT DRILL: The player tosses the dart and is required to identify the alphabet that the dart has landed on. The player is then required to give an event found in the Bible that begins with that letter. Points are awarded, based on the scoring system above, until the player fails to answer correctly.

BIBLE BOOK DRILL: The player tosses the dart and is required to identify the alphabet that the dart has landed on. The player is then required to give a Book of the Bible that begins with that letter. Points are awarded, based on the scoring system above, until the player fails to answer correctly. There are some alphabets that do not correspond to a book in the Bible. The player should declare that there is no book that begins with that letter. If the response is correct, the player gets a free throw.

BIBLE DRILL: This Drill allows players to access the Bible to provide their responses once the player tosses the dart and identifies the alphabet that the dart has landed on. Players have sixty seconds to find a word, character, book, or event that begins with that letter. The players are then required to indicate which they choose to identify (word, character, event, book) that begins with the letter that the dart landed on. Because the Bible was used only half of the points are awarded based on the scoring system above up to the point where the player fails to answer correctly.

To prevent players from making up words, character, book, or event, a challenge can be made by any player to check the accuracy of words, characters, books, or events. It is suggested that a word, character, book or event not be repeated more than twice per game to encourage learning new words, characters, biblical events . . . etc.

From the above description it can be seen that the present invention is able to provide an educational game that provides a learning system including the teaching concepts or methods. In addition, the learning system includes a specifically designed game board with key information printed thereon for use in teaching various subjects. The learning system enables children and adults to learn scriptures, alphabets, a plurality of words, spelling, definitions, grammar, characters, historical events . . . etc. Furthermore, the learning system apparatus of the present invention is simple and easy to use and economical in cost to manufacture.

While certain novel features of this invention have been shown and described and are pointed out in the annexed claims, it is not intended to be limited to the details above, since it will be understood that various omissions, modifications, substitutions and changes in the forms and details of the apparatus illustrated and in its operation can be made by those skilled in the art without departing in any way from the spirit of the present invention.

From the foregoing it will be seen that this invention is one well adapted to attain all of the ends and objects hereinabove set forth, together with other advantages which are obvious and which are inherent to the apparatus and method disclosed.

It will be understood that each of the elements described above, or two or more together may also find a useful application in other types of methods differing from the type described above. It will be understood that certain features and sub-combinations are of utility and may be employed without reference to other feature or sub-combinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. The method for an educational learning system for one or more players for teaching and learning scriptures, the steps of the method comprising:

a) providing the player with or access to a Bible;

b) providing the player with one or more game pieces projectiles;

c) providing a game board comprising:

a game board having a playing surface to receive a game piece projectile, said surface having a plurality of target areas arranged on the playing surface; each target area having a word or clue associated with the Bible and each target area being assigned a point value;

d) having each of the players consecutively taking a turn within a time allotment given to the player;

the steps of each turn comprising:

1) prior to projecting a game piece at the target area, having each player recite from memory a scripture in the Bible;

2) projecting one or more game pieces at the target area, 3) allowing the player's response to be challenged by other players prior to the next player tossing a game piece projectile;

4) permitting the player to refute the challenge by showing continuity of the quoted scripture and the scripture as found in the bible;

5) assigning points to the challenger if the answer is incorrect or to the player if the answer is correct;

e) generating a score at the completion of each player's turn based on the point values of the target areas the thrown game piece landed on;

f) repeating steps d and e until a winner is determined by reaching pre-determined or pre-agreed to goal.

2. The method for an educational learning system for one or more players for teaching alphabets, words, events, characters in the Bible and how to use many Biblical reference materials comprising the steps of:

a) providing a game board comprising:

a game board having a playing surface to receive a game piece projectile, said surface having a plurality of target areas arranged on the playing surface; each target area depicting a different upper and lower case alphabet letter, and each target area being assigned a point value;

b) providing the player with one or more game pieces projectiles;

c) having each of the players consecutively take a turn within a time allotment given to the player, the steps of each turn comprising:

1) tossing a game piece at a target area, 2) having each player provide a response based on the target area landed on by the game piece including at least one or more of the following steps:

i) identifying the alphabet letter landed on;

ii) identifying the type of alphabet letter in the target area landed on as a vowel or consonant, iii) providing a word from the Bible that starts with said alphabet character;

iv) locating said word in said Bible;

v) reading aloud the chapter and verse of the Bible that said word is located;

vi) providing the name of a character from the Bible that starts with the said character;

vii) providing an event from the Bible that contains the said character;

viii) providing a name of a Book in the Bible that contains the said character;

e) generating a score at the completion of each player's turn based on the point values of the target areas and answers to the correct responses given by the player;

f) repeating steps d and e until a winner is determined by reaching pre-determined or pre-agreed to goal.

3. The method for an educational learning system for one or more players for teaching alphabets, words, spelling, grammar, definition and how to use various reference materials such as a dictionary and thesaurus comprising the acts of:

a) providing a game board comprising:

a game board having a playing surface to receive a game piece projectile, said surface having a plurality of target areas arranged on the playing surface; each target area depicting a different upper and lower case alphabet letter, and each target area being assigned a point value;

b) providing the player with one or more game pieces projectiles that are darts;

c) having each of the players consecutively take a turn within a time allotment given to the player, the steps of each turn comprising:

1) tossing a game piece at a target area, 2) having each player provide a response based on the target area landed on by the game piece including at least one or more of the following steps:

i) identifying the alphabet letter landed on;

ii) identifying the type of alphabet letter in the target area landed on as a vowel or consonant, iii) providing a word that starts with said alphabet character;

iv) providing the correct spelling for said word;

v) provides a sentence that contains said word vi) having the player identify the "part of speech" of said word as used in said sentence;

3) permitting the player to use reference materials such as a dictionary and obtaining a reduced score for using the reference material, d) generating a score at the completion of each player's turn based on the point values of the target areas and answers to the correct responses given by the player;

e) repeating steps c and d until a winner is determined by reaching pre-determined or pre-agreed to goal.

* * * * *